US007223135B2

(12) United States Patent
Nora et al.

(10) Patent No.: US 7,223,135 B2
(45) Date of Patent: May 29, 2007

(54) TERMINAL FITTING AND A CONNECTOR PROVIDED THEREWITH

(75) Inventors: Yutaka Nora, Yokkaichi (JP); Ryotaro Ishikawa, Yokkaichi (JP); Hajime Kawase, Yokkaichi (JP); Keiichi Nakamura, Yokkaichi (JP); Yutaka Kobayashi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/344,847

(22) Filed: Feb. 1, 2006

(65) Prior Publication Data

US 2006/0172620 A1 Aug. 3, 2006

(30) Foreign Application Priority Data

Feb. 2, 2005 (JP) ..... 2005-026661
Feb. 2, 2005 (JP) ..... 2005-026662

(51) Int. Cl.
*H01R 11/22* (2006.01)
*H01R 13/11* (2006.01)

(52) U.S. Cl. ..... 439/852; 439/850

(58) Field of Classification Search ..... 439/845, 439/849, 850, 852
See application file for complete search history.

(56) References Cited

U.S. PATENT DOCUMENTS 5,235,743 A 8/1993 Endo et al. ..... 29/885
5,833,500 A * 11/1998 Mahon et al. ..... 439/852
6,152,788 A 11/2000 Hata et al. ..... 439/852
6,244,910 B1 6/2001 Grubbs ..... 439/852
6,527,601 B2 * 3/2003 Chen ..... 439/852
2006/0172619 A1 * 8/2006 Kobayashi et al. ..... 439/852
2006/0172621 A1 * 8/2006 Noro et al. ..... 439/852

FOREIGN PATENT DOCUMENTS

JP 5-190227 7/1993

* cited by examiner

*Primary Examiner*—Hae Moon Hyeon
(74) *Attorney, Agent, or Firm*—Gerald E. Hespos; Anthony J. Casella

(57) ABSTRACT

A terminal fitting has a rectangular tube (10) formed with a locking hole (19). A resilient contact piece (25) is in the rectangular tube (10) for contacting a tab of a mating terminal fitting. Displacement restricting portions (15F, 15R, 18F, 18R) are provided in the rectangular tube (10) at positions before and behind the locking hole (19) for contacting lateral edges of the resilient contact piece (25) and restricting displacement of a resilient contact piece (25) towards a tab entrance space (32). Thus, external matter that may intrude through the locking hole (19) can not cause a damaging deformation of the resilient contact piece (25).

9 Claims, 17 Drawing Sheets

TERMINAL FITTING AND A CONNECTOR PROVIDED THEREWITH

BACKGROUND OF THE INVENTION

1. Field of the Invention

The invention relates to a terminal fitting and to a connector provided therewith.

2. Description of the Related Art

U.S. Pat. No. 5,235,743 and Japanese Unexamined Patent Publication No. 05-190227 disclose a terminal fitting with a rectangular tube that has a front end for receiving a tab. A resilient contact extends in forward and backward directions in the rectangular tube and contacts the tab inserted into the rectangular tube. A locking hole is formed in a plate of the rectangular tube at a side of the resilient contact opposite the tab. The terminal fitting is inserted into a cavity of a connector housing and is retained therein by the engagement of the locking hole with a resiliently deformable lock provided at an inner wall of the cavity.

The resilient contact is accessible through the locking hole from the outside of the rectangular tube. Thus, there is a possibility that external matter may intrude into the rectangular tube through the locking hole and may displace the resilient contact sufficiently to plastically deform a support of resilient deformation of the resilient contact while narrowing the tab entrance space. As a result, frictional resistance between the resilient contact and the tab may be increased.

Consideration may be given to forming the resilient contact with projections that project out along the width direction from the opposite left and right edges of the resilient contact. The projections could engage edges of locking holes formed in side plates of the rectangular tube. The engagement of the projections with the locking holes limits the amount of displacement of the resilient contact that can be caused by the intrusion of external matter through the locking hole.

However, the locking holes can reduce the strength of the side plates and hence can reduce the strength of the entire rectangular tube.

The invention was developed in view of the above problem, and an object thereof is to improve a terminal fitting and a connector provided therewith, and particularly to prevent plastic deformation of a resilient contact piece caused by external matter that enters through a locking hole and/or to avoid a reduction in the strength of a rectangular tube portion.

SUMMARY OF THE INVENTION

The invention relates to a terminal fitting with a tube for receiving a tab insertable from the front. A resilient contact is provided in the tube and extends substantially in forward and backward directions. The resilient contact is configured to contact the tab while being resiliently deformed. Displacement restricting portions are provided at longitudinal positions for restricting displacement of the resilient contact towards the tab entrance space by contacting a lateral edge of the resilient contact.

A locking hole preferably is formed in a plate of the tube at a side of the resilient contact substantially opposite to a tab entrance space. The terminal fitting can be inserted in a cavity of a connector housing and is retained by the engagement of the locking hole with a lock provided at an inner wall of the cavity.

Two displacement restricting portions preferably are provided at two positions before and behind the locking hole in the tube.

External matter could intrude through the locking hole and could push the resilient contact. However, the displacement of the resilient contact towards the tab entrance space is restricted by the displacement restricting portions at the two positions before and behind the locking hole. Thus, there is no likelihood that the resilient contact piece will incline forward or backward in response to a pushing force from the external matter. Therefore, the plastic deformation of a supporting point of resilient deformation of the resilient contact piece cannot be deformed plastically.

At least one of the displacement restricting portions is near a contact point of the resilient contact with the tab. Thus, the position of the contact point will not change significantly even if the resilient contact is deformed. Accordingly, the resilient contact can be held in contact with the tab with a proper contact pressure.

The resilient contact cantilevers from a plate of the tube, and one of the displacement restricting portions preferably is near a free end of the resilient contact. Thus, a distance between the front and rear displacement restricting portions is long. Accordingly, the amount of deformation is small when external matter pushes the resilient contact between the front and rear displacement restricting portions. As a result, plastic deformation is unlikely to occur between the front and rear displacement restricting portions of the resilient contact.

The terminal fitting preferably is formed by bending a conductive plate to define a rectangular tube that is hollow in forward and backward directions. The tube preferably has a base plate and first and second side plates that extend from opposite sides of the base plate. A ceiling plate extends from the first side plate. At least one locking plate projects substantially perpendicularly from an edge of the ceiling plate and extends along the inner surface of the second side plate.

At least one lateral edge of the resilient contact preferably can contact an extending edge of the locking plate to restrict displacement of the resilient contact piece towards the tab entrance space. Thus, it is not necessary to form a locking hole in the side plate. Accordingly, the side plate and the entire tube are strong.

At least one projection preferably projects out in the width direction from a lateral edge of the resilient contact. The projection preferably can contact a portion of the locking plate.

The widthwise center of the inner space of the tube is deviated from the widthwise center of the outer surfaces of the tube due to the presence of the locking plate. The resilient contact would have to be narrowed by as much as this deviation if an attempt was made to arrange the resilient contact and the tube portion so that their widthwise centers coincide. As a result, a dead space is defined at a side opposite to the locking plate in the inner space of the tube. Moreover, the widthwise center of the resilient contact is deviated from that of the tube towards the side opposite to the locking plate. Therefore, a wide resilient contact is achieved and the dead space in the tube is small.

At least one pressing portion preferably extends from one side plate of the tube and contacts an upper edge of the locking plate from above. The pressing portion prevents an upward displacement of the locking plate, and hence displacement of the resilient contact towards the tab entrance space is prevented more securely.

The upper edge of the locking plate preferably forms a recess, and at least part of the pressing portion is accommodated in the recess. Thus, there is little or no step between the upper surface of the ceiling plate and the upper surface of the pressing portion.

The invention also relates to a connector with a housing having at least one cavity and at least one of the above described terminal fittings is inserted into the cavity.

These and other features of the invention will become more apparent upon reading the following detailed description and accompanying drawings.

DETAILED DESCRIPTION OF THE PREFERRED EMBODIMENTS

Figure 1:
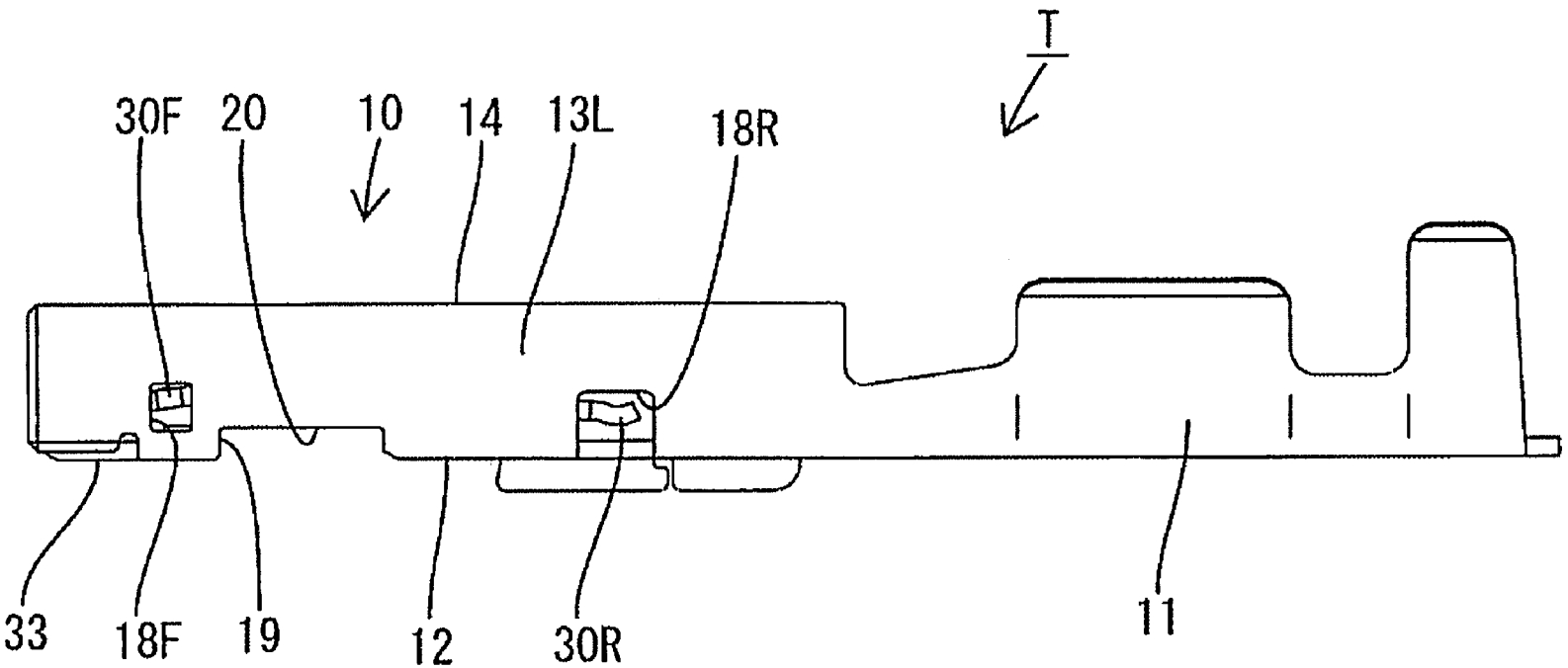
FIG. 1 is a right side view of a terminal fitting according to one embodiment of the invention.
Figure 2:
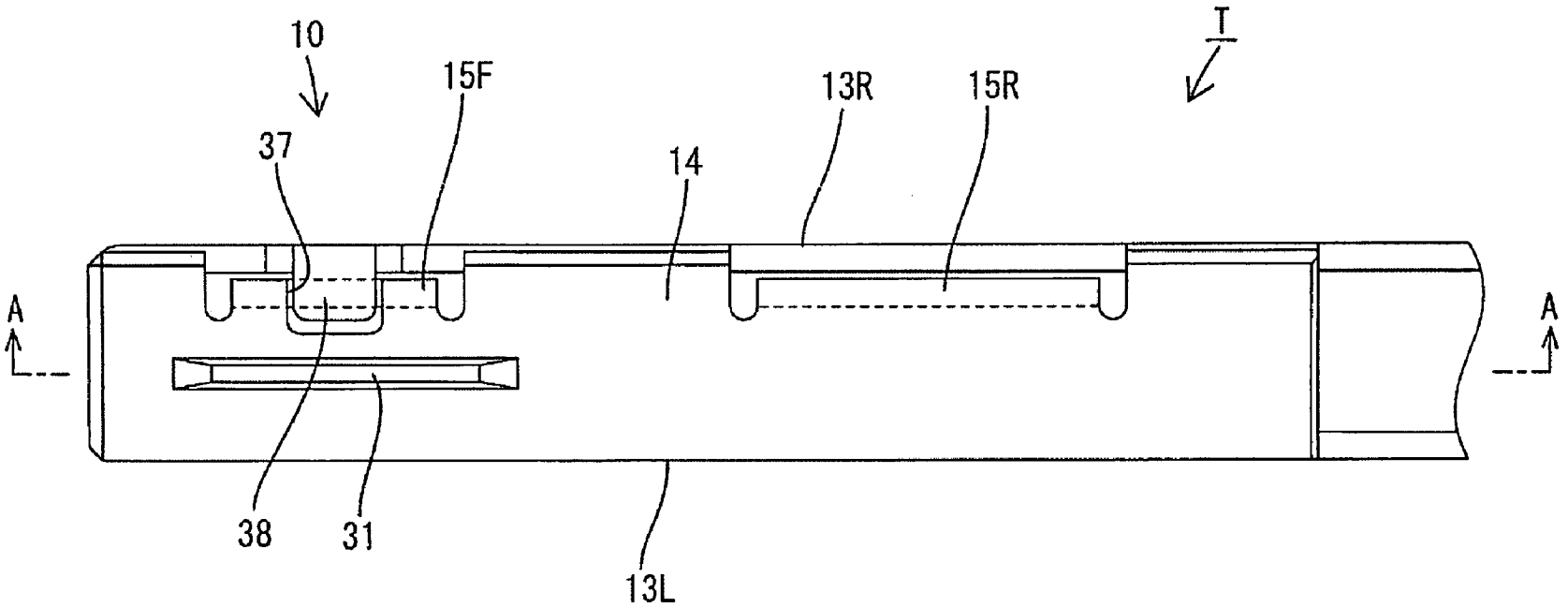
FIG. 2 is a plan view of the terminal fitting.
Figure 3:
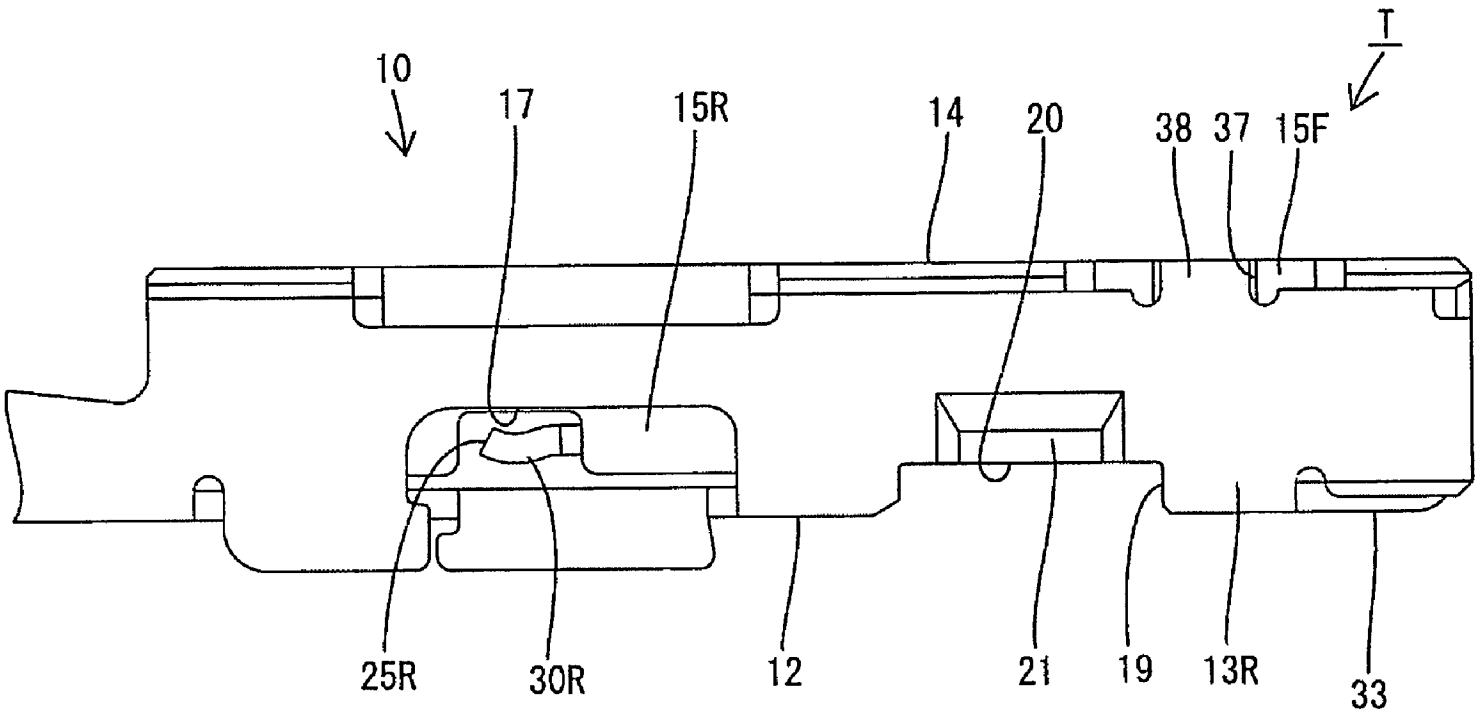
FIG. 3 is a left side view of the terminal fitting.
Figure 4:
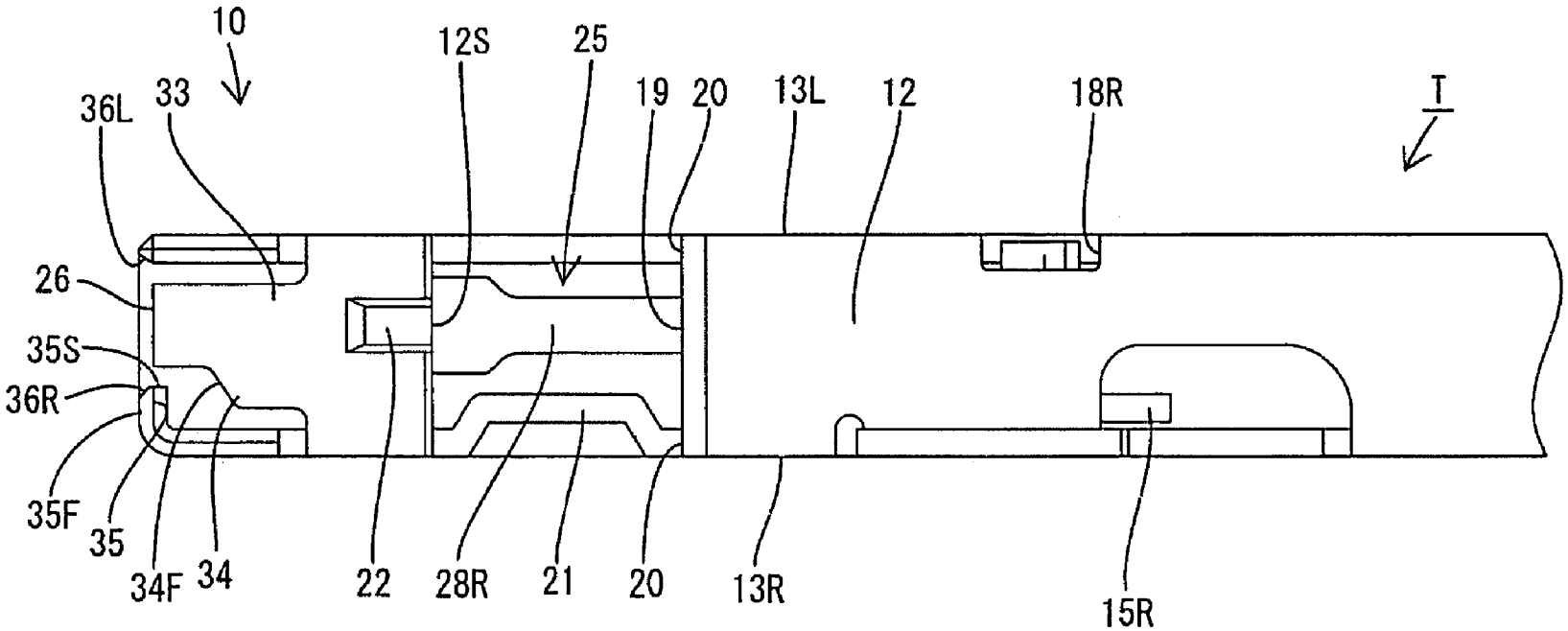
FIG. 4 is a bottom view of the terminal fitting.

A terminal fitting according to the invention is identified by the letter T in FIGS. 1 to 12. The terminal T can be used with a connector housing identified by the numeral 50 in FIGS. 13 to 18. The housing 50 is made e.g. of a synthetic resin and cavities 51 penetrate the housing 50 in forward and backward directions. A lock 52 is cantilevered forward along the bottom wall of each cavity 51 and a retaining projection 52*a* is formed on the surface of each lock 52 facing the cavity 51.

A front plate 53 is movable vertically along the front of the housing 50 and substantially normal to the forward and backward directions between a partial locking position 1P and a full locking position 2P. Tab insertion openings 55 and work openings 56 extend through the front plate 53. The work openings 56 substantially align with the cavities 51 when the front plate 53 is at the partial locking position 1P shown in FIGS. 15 to 17. The tab insertion openings 55 are slightly above the centers of the cavities 51 and the work openings 56 are at positions substantially corresponding to the locks 52 when the front plate 53 is at the full locking position 2P shown in FIGS. 12 to 14.

Figure 10:
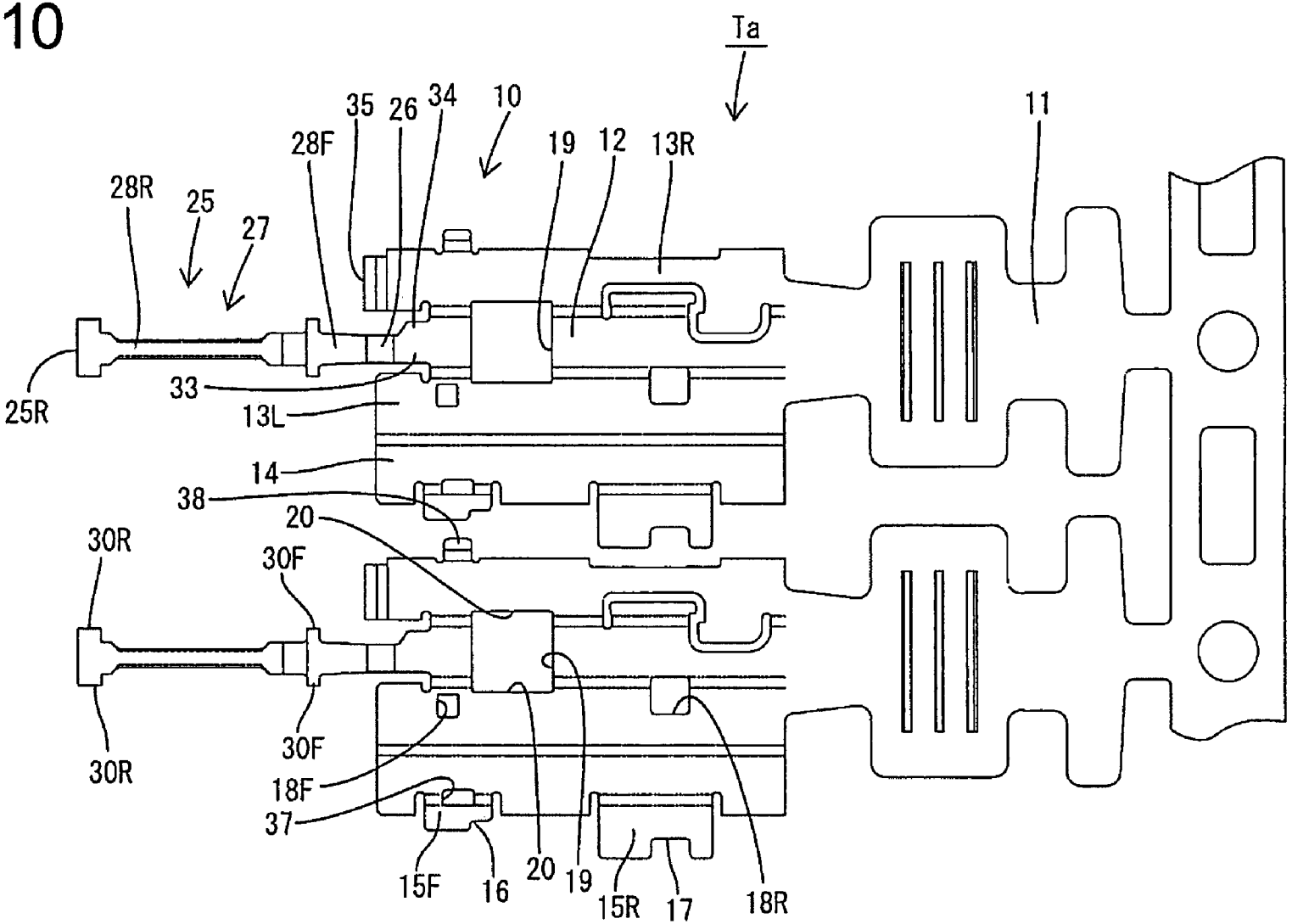
FIG. 10 is a development of the terminal fitting.
Figure 11:
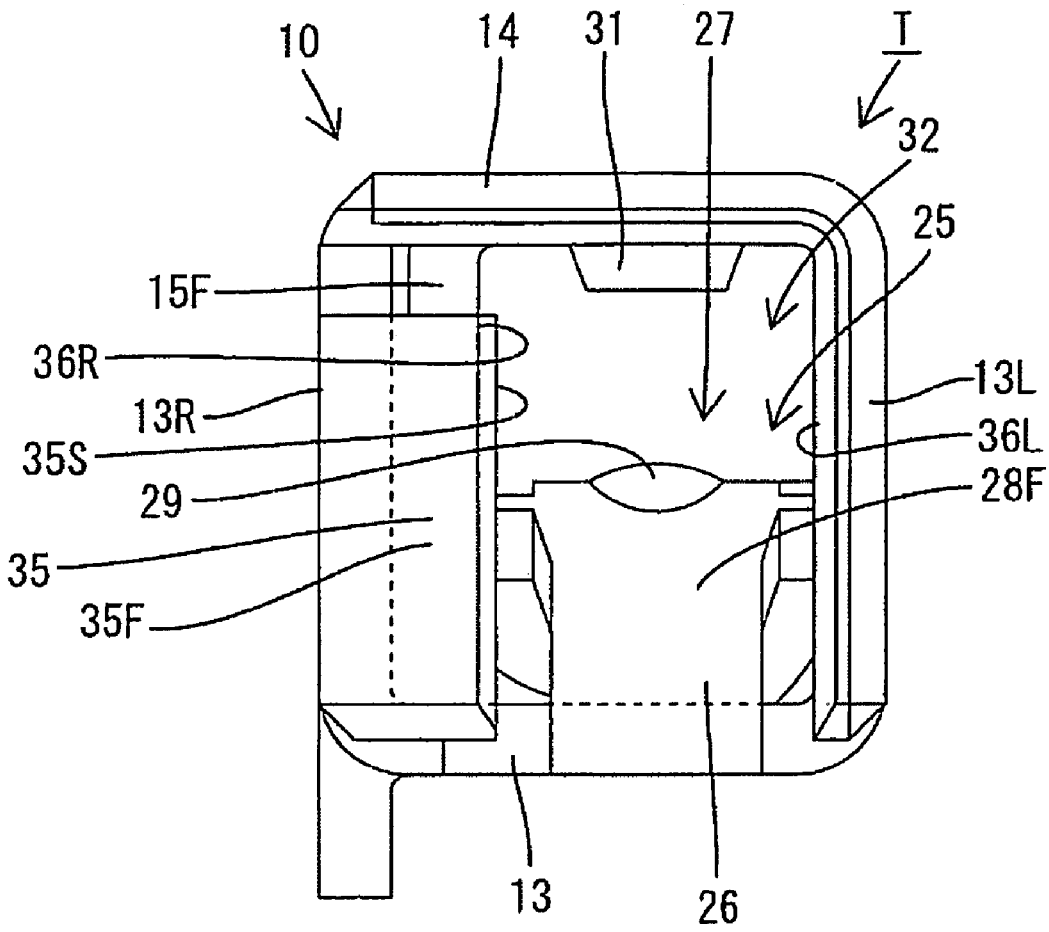
FIG. 11 is a front view of the terminal fitting.
Figure 12:
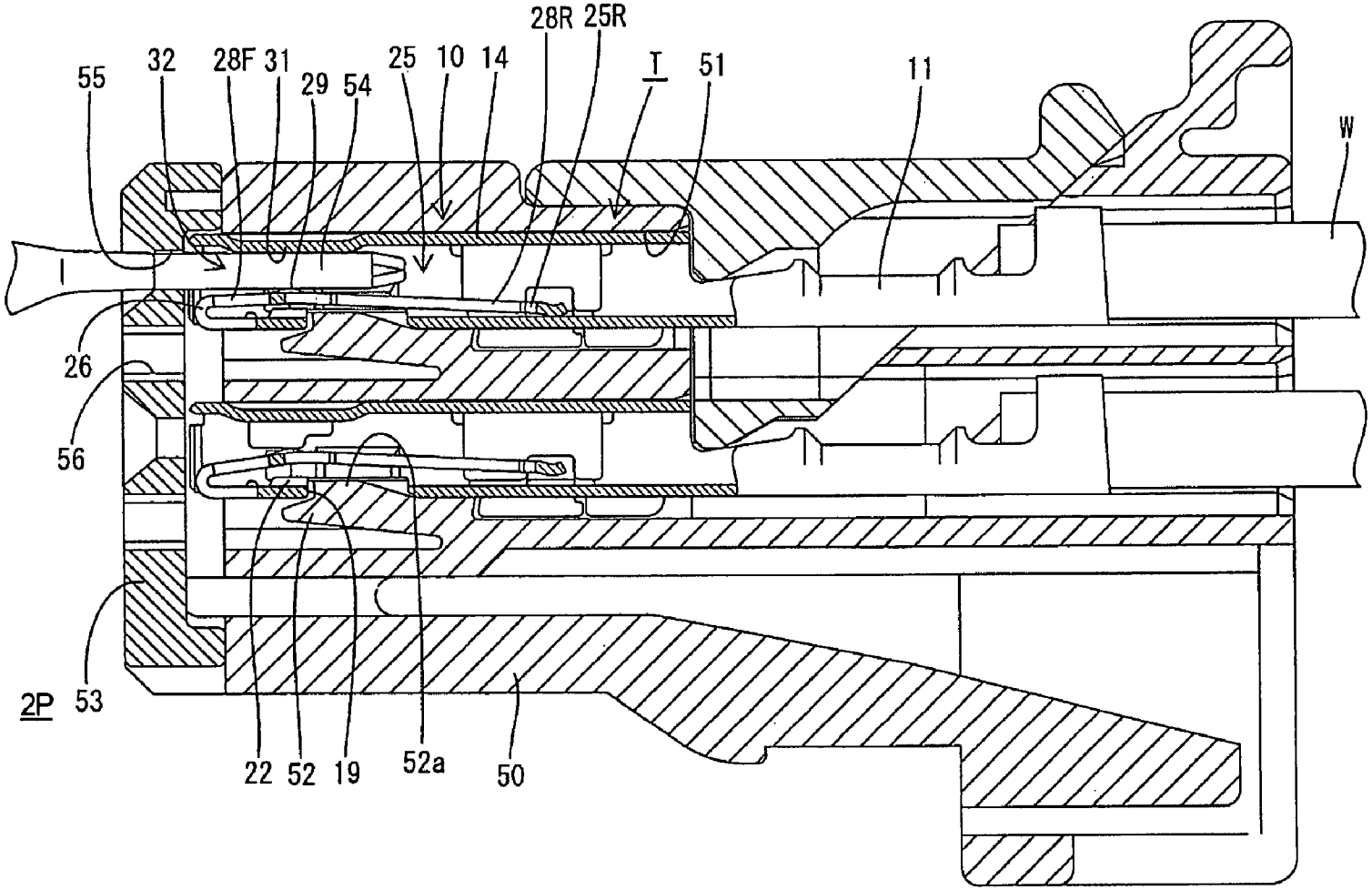
FIG. 12 is a section showing a state where a front plate is at a full locking position and a tab is connected with the terminal fitting.
Figure 13:
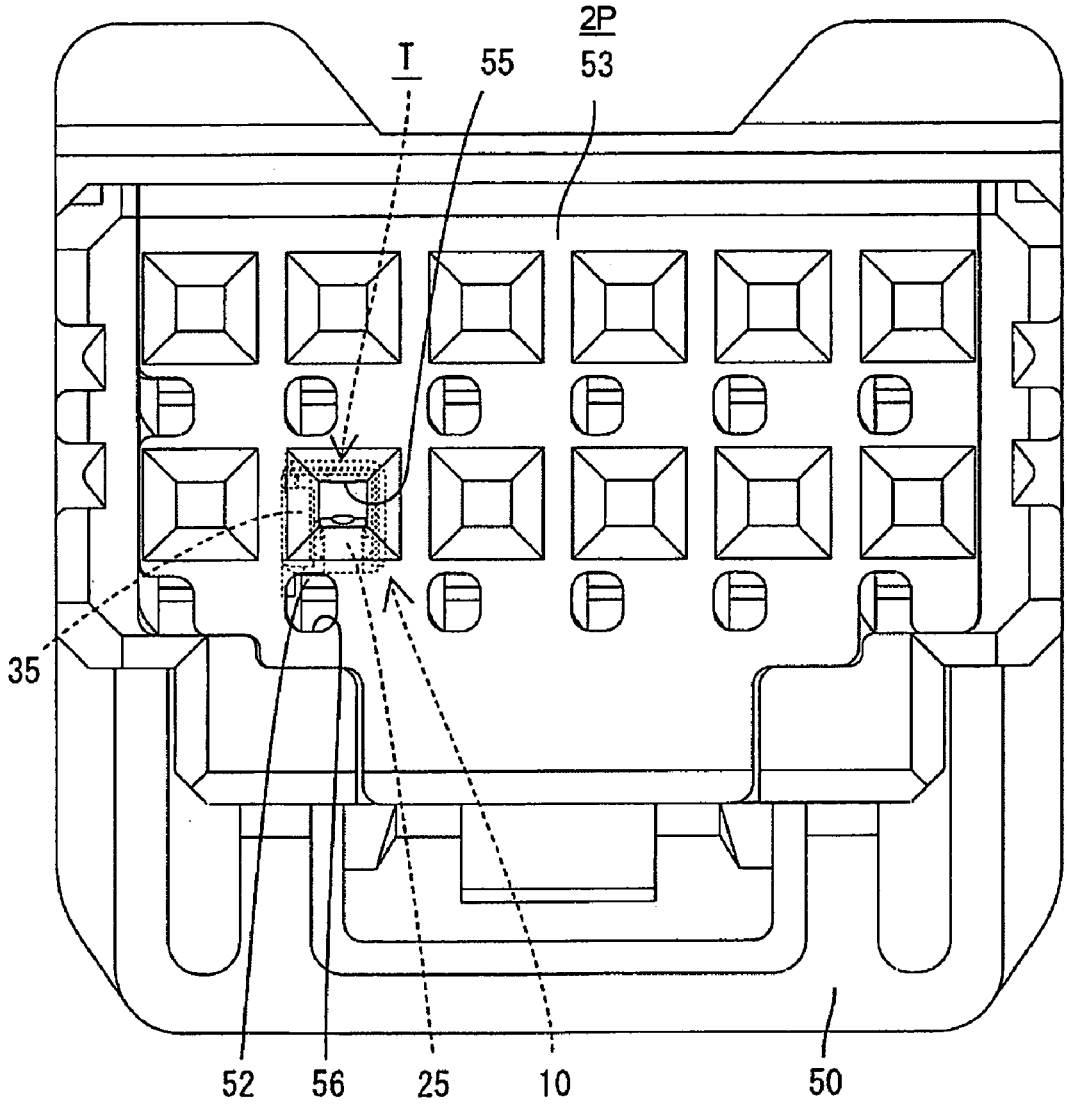
FIG. 13 is a front view of a connector housing showing a state where the front plate is at the full locking position.
Figure 14:
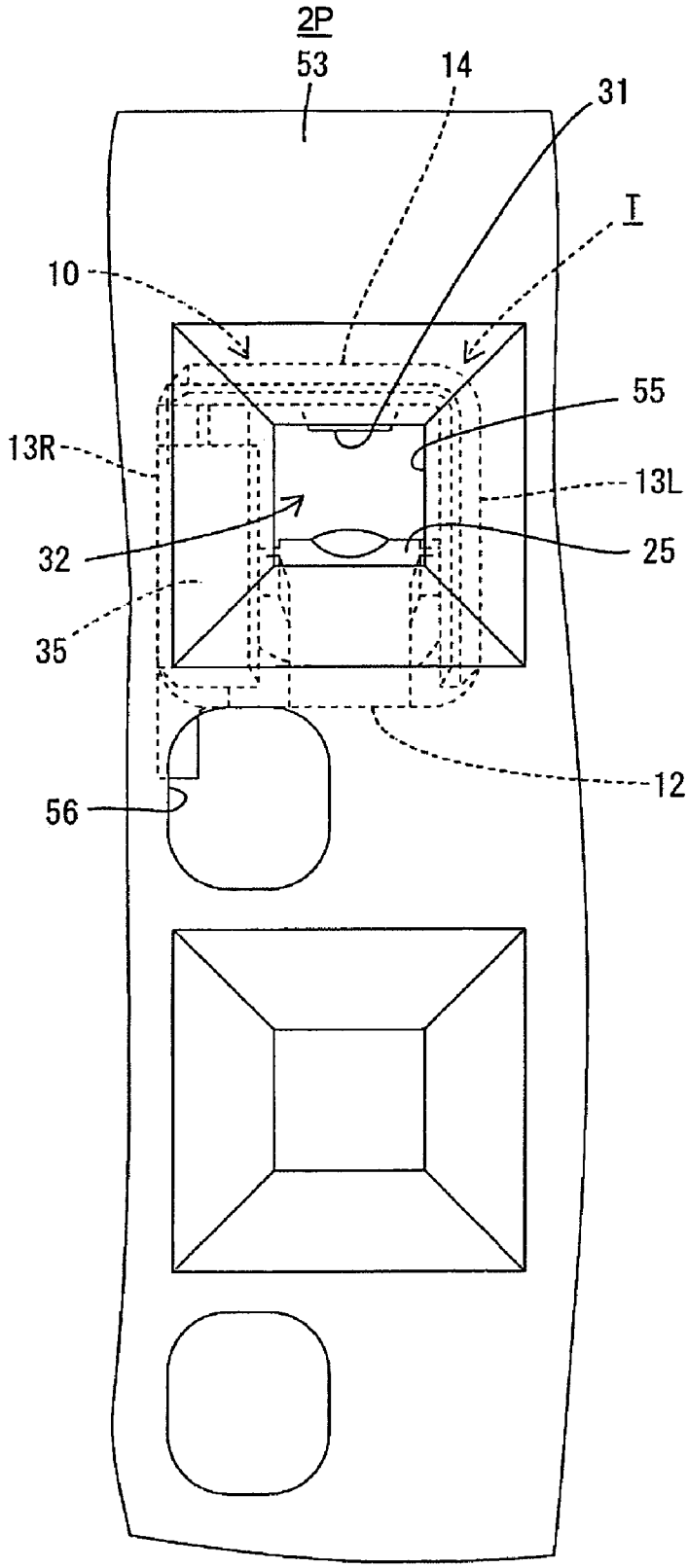
FIG. 14 is an enlarged partial view of FIG. 13.
Figure 15:
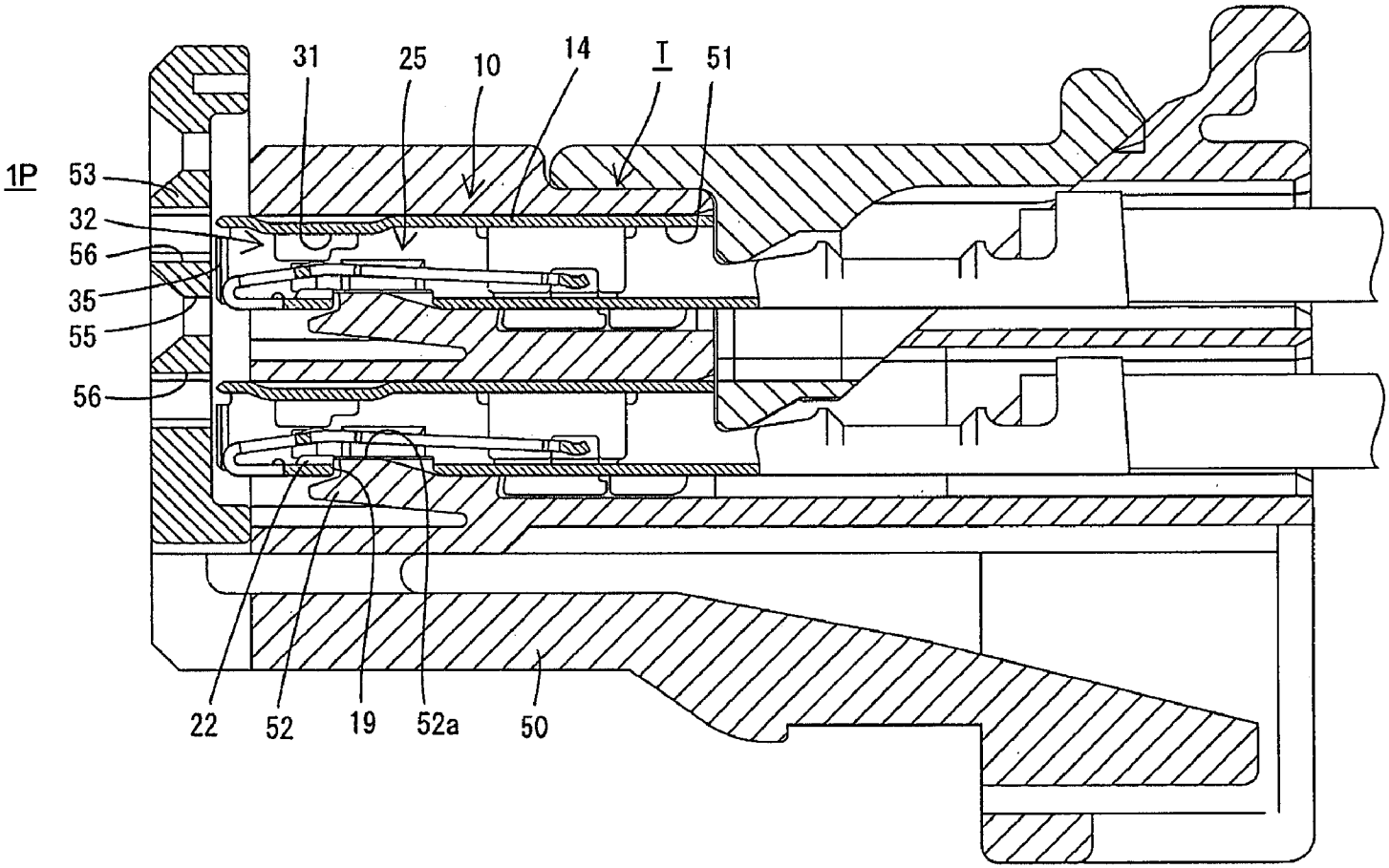
FIG. 15 is a section showing a state where the front plate is at a partial locking position.
Figure 16:
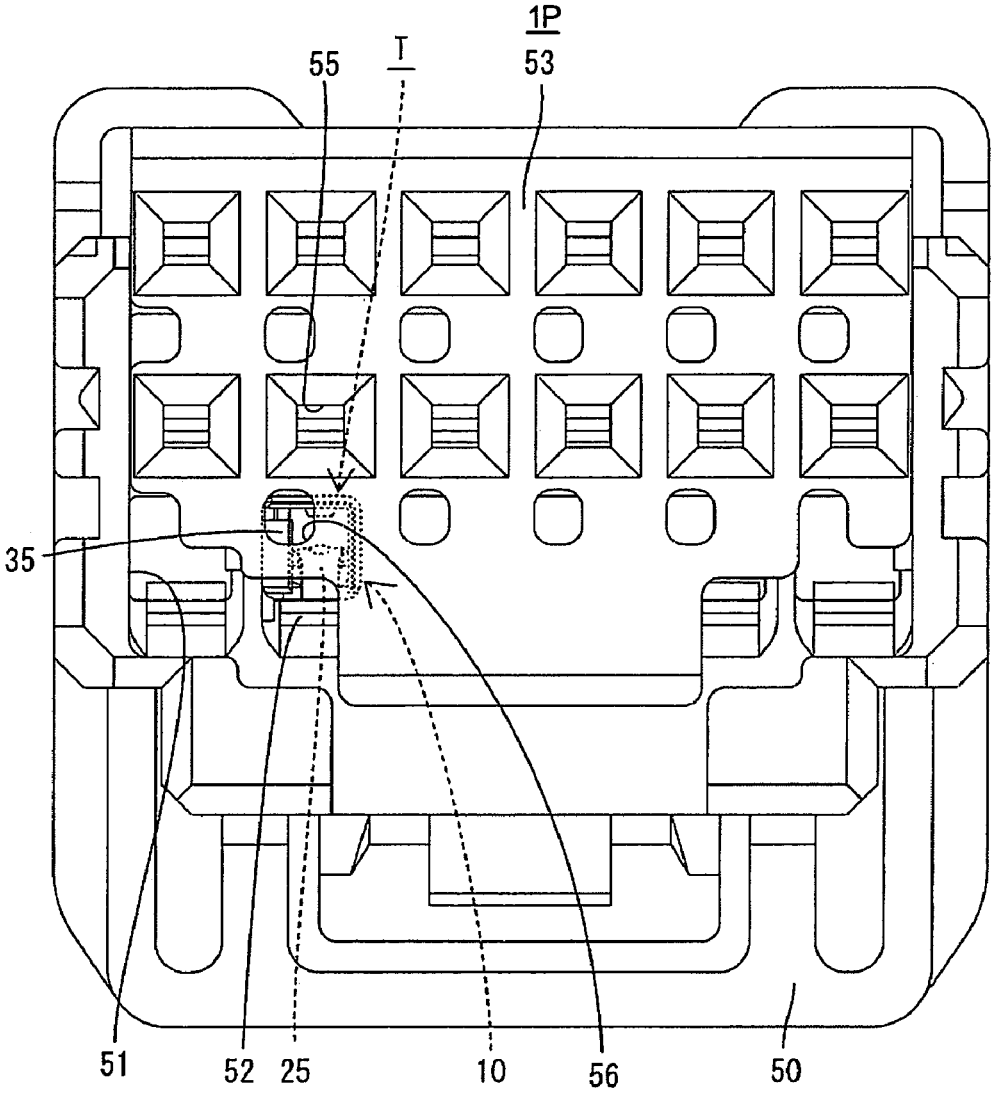
FIG. 16 is a front view of the connector housing showing the state where the front plate is at the partial locking position.
Figure 17:
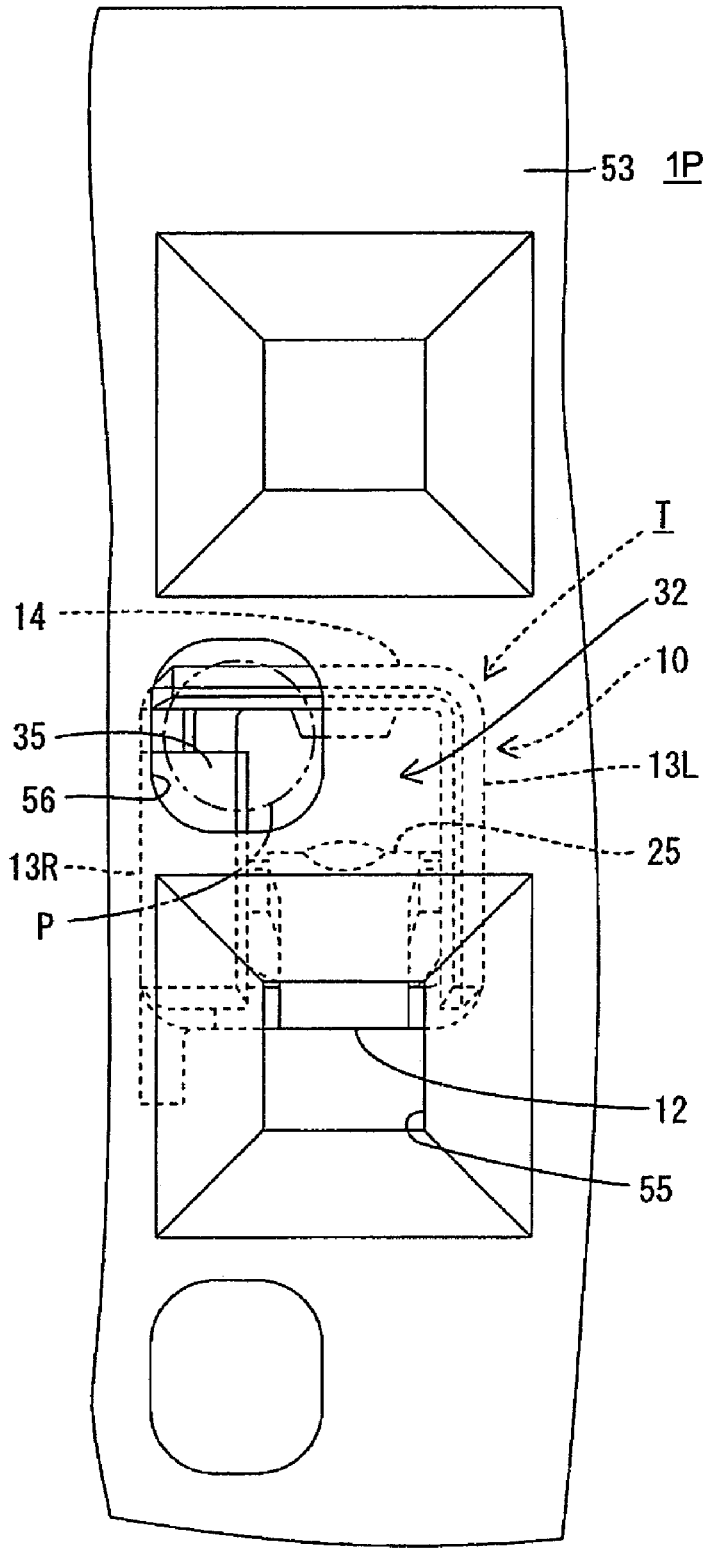
FIG. 17 is an enlarged partial view of FIG. 16.
Figure 18:
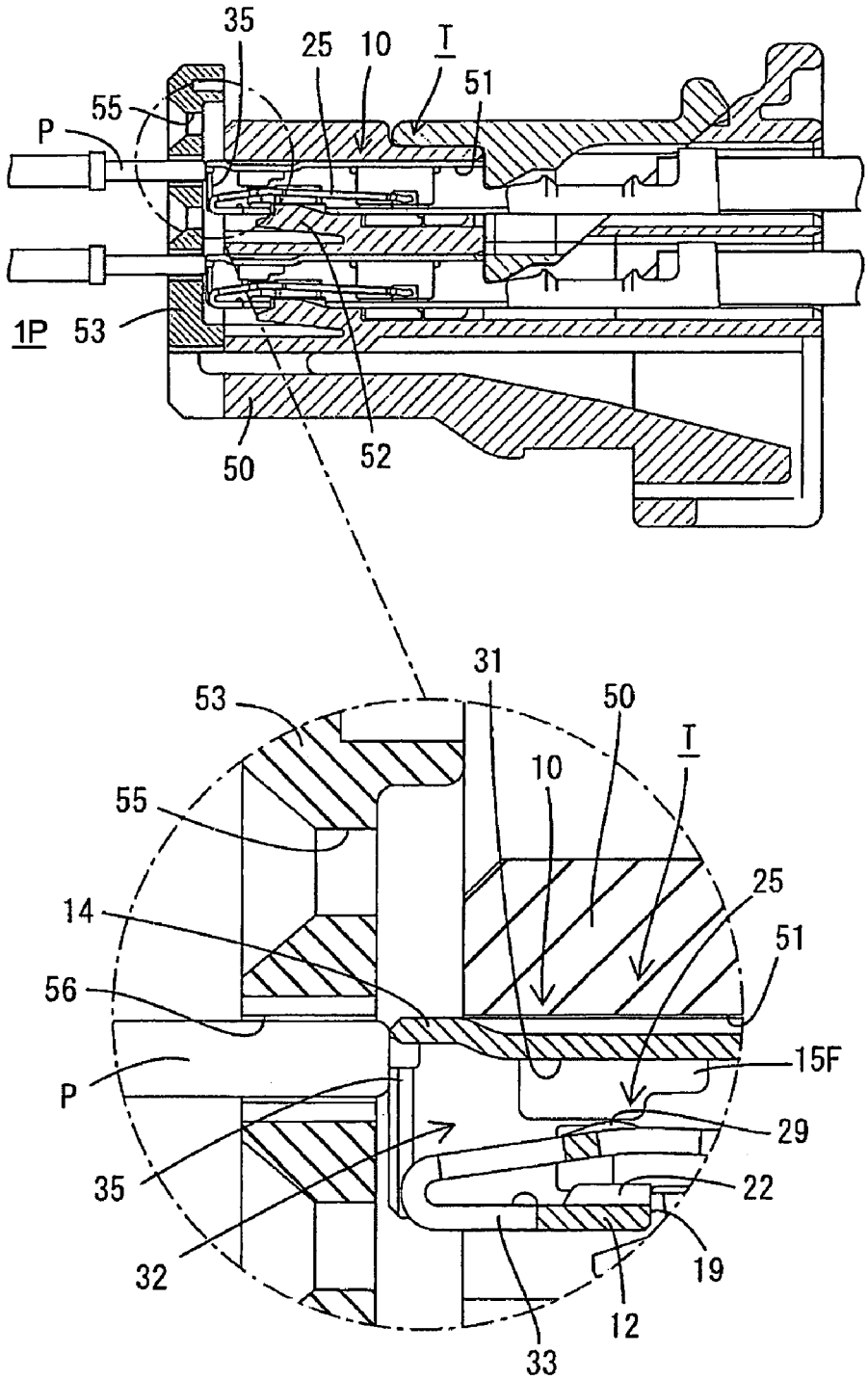
FIG. 18 is a section showing a state where an electrical connection test is conducted using probes.

Each terminal fitting T is formed from a conductive metallic plate material Ta stamped or cut out into a specified shape as shown in FIG. 10 by applying bending, folding, pressing, embossing, etc. and is substantially narrow and long in forward and backward directions. A front portion of the plate Ta is configured to form a substantially rectangular tube 10 and a rear portion is configured to form a wire connecting portion 11 with open barrels that can be crimped, bent or folded into electrical connection with an end of a wire W.

The rectangular tube 10 of the terminal T is substantially hollow in forward and backward directions and has a bottom plate 12 that is long and narrow in forward and backward directions. Left and right side plates 13L, 13R project up from the opposite left and right sides of the bottom plate 12. A ceiling plate 14 extends from the top of the left side plate 13L towards the right side plate 13R and is substantially parallel with the bottom plate 12. Front, rear and intermediate parts of the extending right edge of the ceiling plate 14 contact the upper edge of the right side plate 13R from above, and front and rear locking plates 15F, 15R are formed in front and rear areas of the extending end of the ceiling plate 14 that do not contact the upper edge of the right side plate 13R. The locking plates 15F, 15R extend down substantially along the inner surface of the right side plate 13R. The front locking plate 15F is substantially rectangular and the bottom edge thereof is in an intermediate position of the rectangular tube 10 with respect to the height direction. A rear notch 16 is formed at the rear end of the bottom edge of the front locking plate 15F. The rear locking plate 15R also is substantially rectangular, and the bottom edge thereof is at a low position near the bottom plate 12 in the rectangular tube 10. A bottom notch 17 is formed in an intermediate position of the bottom edge of the rear locking plate with respect to forward and backward directions. Substantially rectangular front and rear locking holes 18F, 18R penetrate the left side plate at positions corresponding respectively to the bottom edge of the front locking plate 15F and the bottom notch 17 of the rear locking plate 15R.

A substantially rectangular locking hole 19 is formed in the bottom plate 12. Additionally, the bottom edges of the left and right side plates 13L, 13R are cut to a position slightly higher than the upper surface of the bottom plate 12 in areas corresponding to the locking hole 19 with respect to forward and backward directions to form transversely symmetrical side notches 20. Thus, the left and right side plates 13L, 13R have bottom edges in the opening area of the locking hole 19. An area of the bottom part of the right side plate 13R corresponding to the locking hole 19 is embossed to project inward towards the widthwise center, thereby forming an intrusion restricting portion 21. The intrusion restricting portion 21 is substantially rectangular in side view (see e.g. FIG. 3) and is substantially trapezoidal in bottom view (see e.g. FIG. 4). The rear notch 16 of the front locking plate 15F is formed to avoid interference with the front end of the upper edge of the intrusion restricting portion 21.

A retaining portion 22 is formed at the front edge of the locking hole 19. The retaining portion 22 is formed by plastically deforming the opening edge of the locking hole 19 in the bottom plate 12 by stamping or embossing to project up and into the rectangular tube 10. The retaining portion 22 includes an edge 12S of the locking hole 19 that will oppose and engage the retaining projection 52*a* of the lock 52 of the housing 50. The retaining portion 22 is displaced to the left along the width direction relative to the rectangular tube 10. Further, the upper surface of the retaining portion 22 is a substantially flat surface located substantially at the same height as the bottom edges of the side notches 20 and the intrusion restricting portion 21.

The retaining portion 22 is arranged at a position displaced laterally (e.g. to left) along width direction (transverse direction) relative to the (rectangular) tube portion 10, wherein the widthwise center of the retaining portion 22 preferably is located at the substantially same position as that of the resilient contact piece 25 to be described later. Further, the upper or inner surface of the retaining portion 22 preferably is a substantially flat surface located substantially at the same height as the bottom edges of the side notches 20 and/or the intrusion restricting portion 21.

Figure 5:
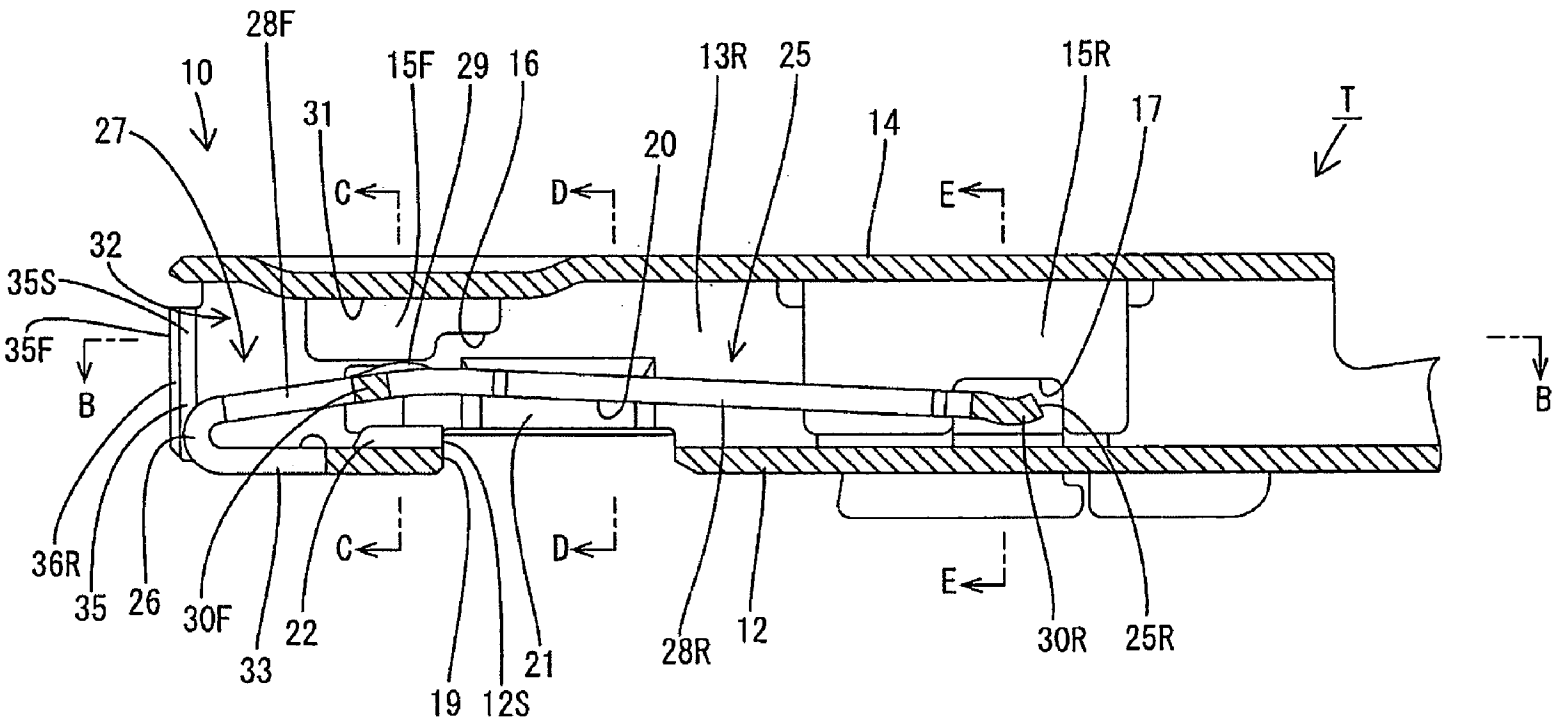
FIG. 5 is a section along 5—5 of FIG. 2.
Figure 6:
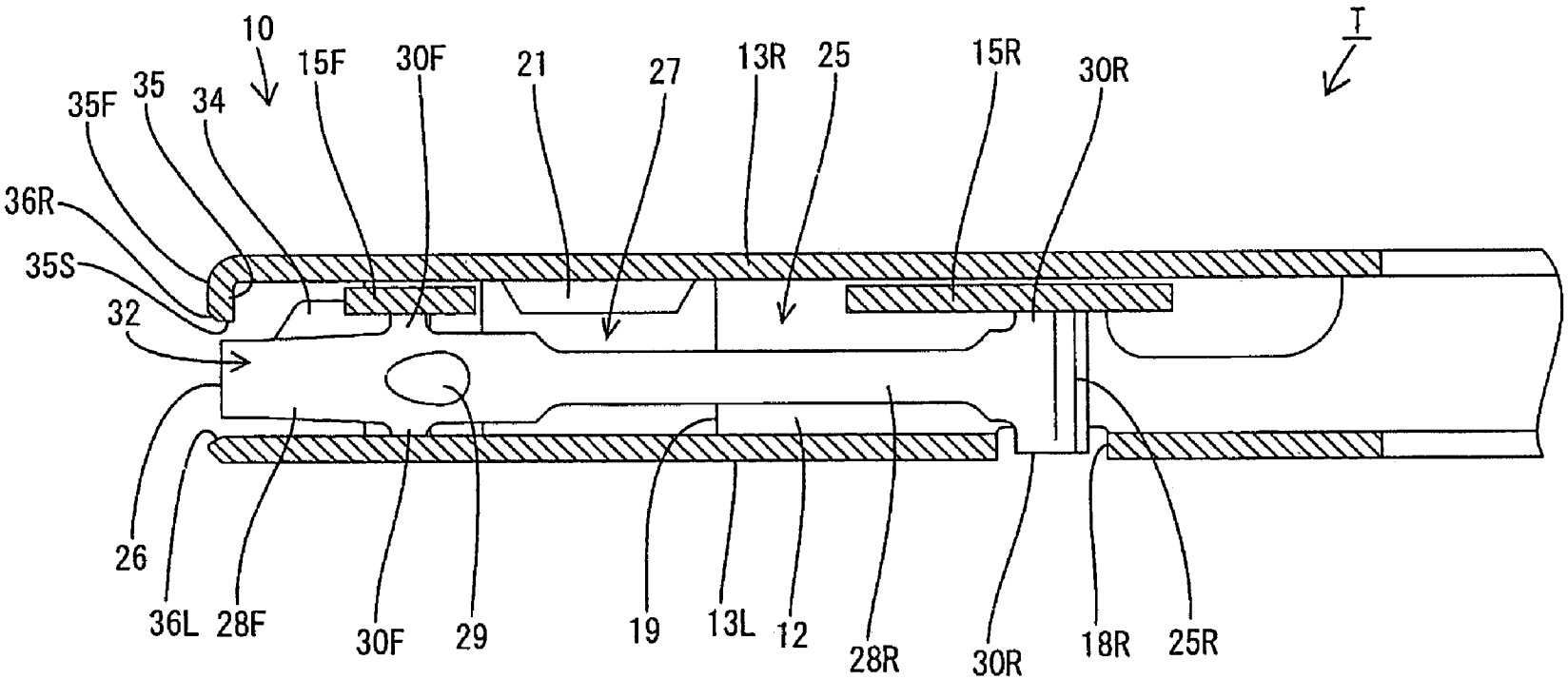
FIG. 6 is a section along 6—6 of FIG. 5.
Figure 7:
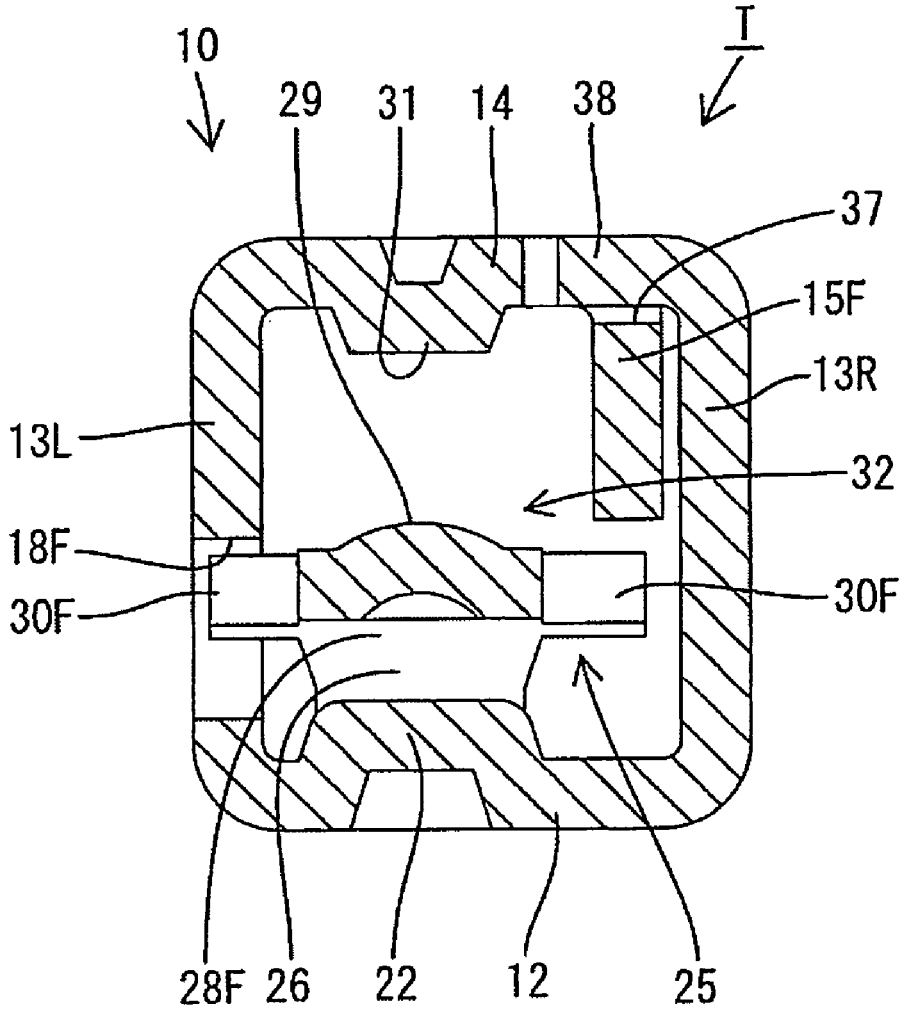
FIG. 7 is a section along 7—7 of FIG. 5.
Figure 8:
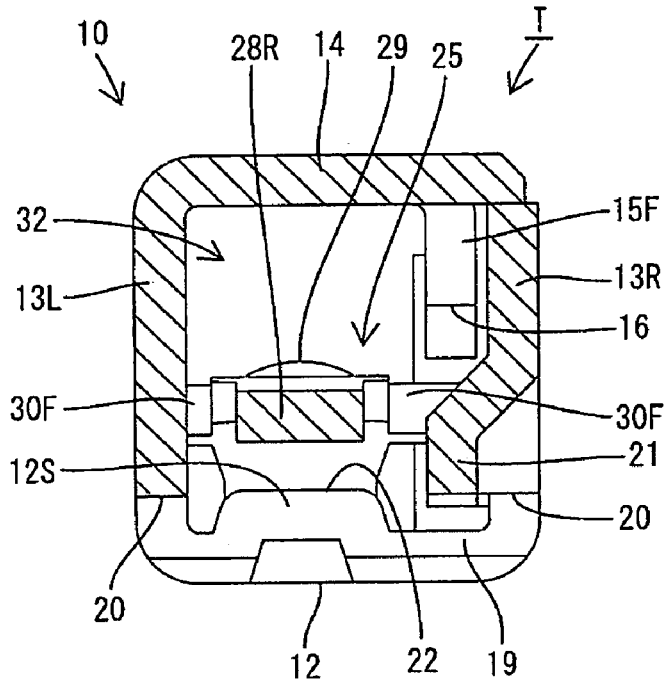
FIG. 8 is a section along 8—8 of FIG. 5.
Figure 9:
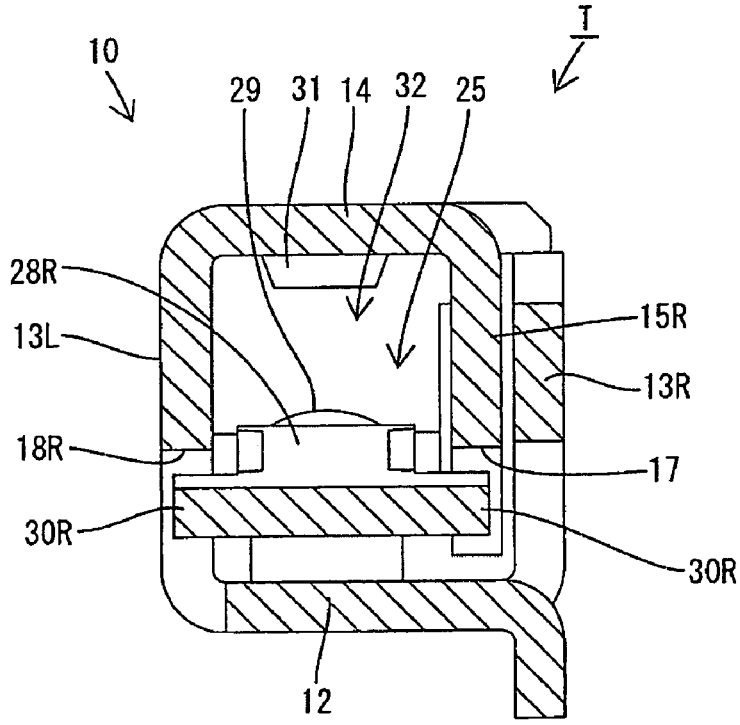
FIG. 9 is a section along 9—9 of FIG. 5.

A resilient contact 25 is accommodated in the rectangular tube 10. As shown in FIG. 5, the resilient contact 25 is long and narrow in forward and backward directions and is bent to cantilever back from the front end of the bottom plate 12. The resilient contact 25 has a substantially semicircular bend 26 connected with the front end of the bottom plate 12, and an extending portion 27 extending back from the bend 26. The extending portion 27 has a forward inclined portion 28F extending obliquely up and to the back from the upper end of the bend 26 and a backward inclined portion 28R extending obliquely down to the back from the rear end of the forward inclined portion 28F. In a free state where the resilient contact 25 is not resiliently deformed, the resilient contact 25 is supported only at its front end and a free end 25R of the resilient contact 25 is at a non-contact position spaced up from the bottom plate 12. The resilient contact 25 is resiliently deformable substantially up and down in a direction intersecting the forward and backward directions with the bend 26 as a supporting point while mainly resiliently deforming the bend 26. When the resilient contact 25 is deformed down, the free end 25R of the resilient contact 25 contacts the upper surface of the bottom plate 12 so that the resilient contact 25 is supported at both front and rear ends.

The bend 26 and the forward inclined portion 28F are in an area before the locking hole 19, and a substantially dome-shaped contact point 29 projects up at the rear end (i.e. highest part) of the front forward portion 28F. This contact point 29 also is located before the locking hole 19. The backward inclined portion 28R extends in an area from the front edge of the locking hole 19 to the bottom notch 17 of the rear locking plate 15R, and the front end thereof is at a height substantially corresponding to the intrusion restricting portion 21. Further, the widths of the bend 26 and the forward inclined portion 28F are substantially equal; the widths of the front and rear ends of the backward inclined portion 28R are substantially equal to the width of the forward inclined portion 28F; and an area of the backward inclined portion 28R except the front and rear ends thereof is narrower than the forward inclined portion 28F.

Front and rear projections 30F, 30R are formed at each of the left and right edges of the resilient contact 25. The front and rear projections 30F, 30R are substantially flush with the resilient contact 25 in the thickness direction, but bulge outward transversely. The left and right front projections 30F are substantially symmetrical to each other and arranged slightly before the contact point 29. The front projections 30F substantially correspond to the bottom edge of the front locking plate 15F and the front locking hole 18F with respect to forward and backward directions. In the free state, where the resilient contact 25 is not deformed, the upper surface of the right front projection 30F is slightly below the bottom edge of the front locking plate 15F and does not contact the bottom edge, and the upper surface of the left front projection 30F is slightly below the upper edge of the front locking hole 18F and does not contact this upper edge. On the other hand, the rear projections 30R are transversely symmetrical and are close to the free rear end 25R of the resilient contact 25. The rear projections 30R are located to correspond to the upper edge of the bottom notch 17 of the rear locking plate 15R and the rear locking hole 18R with respect to forward and backward directions. In the free state, where the resilient contact 25 is not resiliently deformed, the upper surface of the right rear projection 30R is slightly below the upper edge of the bottom notch 17 and not in contact with this upper edge, and the upper surface of the left rear projection 30R is slightly below the upper edge of the rear locking hole 18R and not in contact with this upper edge.

The resilient contact 25 is substantially transversely symmetrical and displaced to the left along the width direction relative to the rectangular tube 10 and the locking hole 19. The widthwise center of the resilient contact 25 substantially coincides with that of the retaining portion 22. When the locking hole 19 is viewed from below, a front-end area of the backward inclined portion 28R of the resilient contact 25 is exposed over substantially its entire width. The ceiling plate 14 is embossed to project downward, thereby forming a tab receiving portion 31. The widthwise center of the tab receiving portion 31 also substantially coincides with that of the resilient contact 25. A space between the upper surface of the resilient contact 25 and the lower surface of the tab receiving portion 31 serves as the tab entrance space 32 for receiving the tab 54 inserted into the rectangular tube 10 from the front.

A base portion 33 is formed by cutting or stamping the left and right edges of a front end portion of the bottom plate 12. Thus, the base portion 33 is narrower than the bottom plate 12 and hence narrower than the substantially rectangular tube 10. Additionally, the base portion 33 is displaced laterally to the left relative to the rectangular tube 10 or its longitudinal axis. The widthwise center of the base portion 33 substantially coincides with the widthwise center of the resilient contact 25. Thus, the base portion 33 and the resilient contact 25 are arranged to have their widthwise centers located at the substantially same position. The bottom end of the bend 26 extends unitarily from the front end of the base portion 33, and the left edge of the base portion 33 and that of the bend 26 are substantially continuous and flush with each other. On the other hand, a bulge 34 bulges out laterally toward the right side plate 13R from the right edge of the base portion 33 (i.e. at the side edge substantially opposite to the side toward which the base portion 33 is displaced relative to the rectangular tube 10). The right edge of the bulge 34 is substantially parallel to the left edge of the base portion 33, and a front edge 34F of the bulge 34 is oblique to the side edges of the base portion 33 and the bulge 34. The widthwise center of a plate portion that comprises the base portion 33 and the bulge 34 substantially coincides with that of the rectangular tube 10.

A substantially flat receiving plate 35 extends from the front edge of the right side plate 13R substantially at right angle towards the widthwise center and towards the resilient contact 25. In this regard, the right side plate 13R is the side plate opposite the side towards which the widthwise center of the resilient contact 25 is deviated. The receiving plate 35 is continuous from a position near the upper end of the right side plate 13R to a position near the bottom end thereof, and has a vertically long substantially rectangular front view. The receiving plate 35 extends into a space left upon forming the base portion 33 and the bottom edge of the receiving plate 35 is located at least partly within the thickness area of the bottom plate 12 and the upper edge of the receiving plate 35 is substantially at the same height as the lower surface of the tab receiving portion 31. A front end surface 35F of the receiving plate 35 is located slightly before the front end of the resilient contact 25, and hence before the front end of the bend 26. An extending edge 35S of the receiving plate 35 is substantially straight and parallel to the right side plate 13R and is in an area between the inner surface of the right side plate 13R and the corresponding right surface of the bend 26 and more specifically at a position near the right edge of the bend 26 with respect to the width direction. Thus, the receiving plate 35 is outside the tab entrance space 32 between the tab receiving portion 31 and the resilient contact 25 with respect to the width direction. A slanted guide surface 36R is formed at the extending edge 35S of the receiving plate 35. On the other hand, a similarly slanted guide surface 35L is formed at the front end of the left side plate 13L. The widthwise center of a space defined between the extending edge 35S of the receiving plate 35 and the inner surface of the left side plate 13L substantially coincides with the widthwise centers of the base portion 33 and the resilient contact 25.

The top part of the front locking plate 15F and part of the ceiling plate 14 are cut away in an intermediate part with respect to forward and backward directions to form a recess 37. Therefore, the upper surface of the extending end of the ceiling plate 14 is recessed down (see e.g. FIG. 7) at the recess 37, and the recess 37 extends down through the lower surface of the ceiling plate 14 in an area of the recess 37 corresponding to the ceiling plate 14. A pressing portion 38 extends to the left from the top of the right side plate 13R and is accommodated in the recess 37. Thus, the upper surface of the pressing portion 38 is substantially flush with the upper surface of the ceiling plate 14. The pressing portion 38 contacts the upper edge of the front locking plate 15F from above to prevent an upward or outward displacement of both the front locking plate 15F and the ceiling plate 14.

The terminal fitting T is inserted into the cavity 51 from behind, with the front plate 43 held at the partial locking position. In the inserting process, the bottom plate 12 of the rectangular tube 10 contacts the retaining projection 52*a* to deform the lock 52 down. The lock 52 resiliently returns up towards the terminal fitting T when the terminal fitting T is inserted to a proper position. As a result, the retaining projection 52*a* enters the locking hole 19 and the front surface of the retaining projection 52*a* engages the retaining portion 22 of the locking hole 19 from behind to retain the terminal fitting T.

A long narrow conductive metallic probe P can be inserted through the work opening 56 from the front for checking an electrical connection of the inserted terminal fitting T. The probe P contact the upper end of the receiving plate 35 above the resilient contact 25 and at the height corresponding to the tab entrance space 32 and simultaneously contacts the front edge of the ceiling plate 14.

The front plate 53 is moved to the full locking position after checking the electrical connection. In this state, the tab 54 is inserted into the tab entrance space 32 through the tab insertion opening 55 of the front plate 53 from the front. The inserted tab 54 contacts the resilient contact 25 and is held resiliently between the tab receiving portion 31 and the contact point 29 while resiliently deforming the resilient contact 25. Thus, the tab 54 and the rectangular tube 10 are connected electrically by a resilient restoring force of the resilient contact 25.

The edge 12S of the retaining portion 22 at the opening of the locking hole 19 in the bottom plate 12 contacts the lock 52 to retain the terminal fitting T. The edge 12S is displaced inwardly of the rectangular tube 10. Thus, a larger engaging margin can be ensured as compared to a case where only the thickness of the plate serves as an engaging margin.

The retaining portion 22 is displaced inwardly of the rectangular tube 10 while the part of the edge 12S of the bottom plate 12 is held substantially faced in a direction to substantially oppose the lock 52, and a boundary between the lower surface of the bottom plate 12 and the edge 12S is well defined angle. Thus, even if an external force acts on the terminal fitting T in withdrawing direction, there is no likelihood that the lock will slip and disengage from the retaining portion as in the case where the boundary between the lower surface of the bottom plate and the end surface is a curve.

If a degree of downward deformation of the resilient contact piece 25 becomes larger than the one in a normal contact state of the resilient contact 25 with the tab 54 when the tab 54 is inserted, a portion of the resilient contact 25 corresponding to the contact point 29 contacts the retaining portion 22 from above and prevents the resilient contact 25 from deforming beyond its resiliency limit. The retaining portion 22 retains the terminal fitting T and also prevents excessive deformation of the resilient contact 25. Thus, the shape of the terminal fitting T can be simplified as compared to a case where an excessive deformation preventing portion for exclusive use is provided in addition to the retaining portion.

External matter that intrudes through the locking hole 19 could push the resilient contact 25 up from below. However, the front projections 30F contact the bottom edge of the front locking plate 15F and the edge of the front locking hole 18F from below, and the rear projections 30R contact the bottom edge of the rear locking plate 15R and the edge of the rear locking hole 18R from below to prevent the resilient contact 25 from being displaced up towards the tab entrance space 32. Further, the locking plates 15F, 15R and the locking holes 18F, 18R are arranged at positions before and behind the locking hole 19. Thus, there is no likelihood that the resilient contact 25 will incline forward and/or backward upon receiving a pushing force from external matter. As a result, the bend 26, which is the supporting point of resilient deformation of the resilient contact 25, will not be deformed plastically.

The front locking plate 15F and the front locking hole 18F located before the locking hole 19 are in the vicinity of the contact point 29 of the resilient contact 25 with the tab 54, even if an area of the resilient contact 25 other than the bend 26 is deformed. Thus, there is no likelihood of changing the position of the contact point 29. Therefore, the resilient contact 25 can contact the tab 54 with a proper contact pressure.

A rear displacement preventing portion (rear locking plate 15R and the rear locking hole 18R) is behind the locking hole 19 and near the free end 25R of the resilient contact 25. Thus, an interval along forward and backward directions between a front displacement preventing portion (front locking plate 15F and front locking hole 18F) and the rear displacement preventing portion (rear locking plate 15R and rear locking hole 18R) is longer than a case where the rear displacement preventing portion is closer to the supporting point of resilient deformation than to the free end. Accordingly, a degree of deformation of the resilient contact 25 when the resilient contact piece 25 is deformed between the front and rear displacement preventing portions by external matter can be suppressed, and the resilient contact 25 is unlikely to deform plastically between the front and rear displacement preventing portions.

The bottom plate 12 has the locking hole 19 for exposing the resilient contact 25 to the outside of the rectangular tube 10, but the right side plate 13R is formed with the intrusion restricting portion 21 close to the resilient contact 25 and located within the opening area of the locking hole 19. Thus, the intrusion of external matter into the locking hole 19 can be restricted by the intrusion restricting portion 21, which in turn prevents the interference of external matter with the resilient contact 25.

The intrusion restricting portion 21 is outside a deformation space for the resilient contact 25 with respect to the width direction. Thus, the interference of the resilient contact 25 and the intrusion restricting portion 21 can be avoided. Accordingly, the contact reliability of the tab 54 and the resilient contact 25 is ensured without hindering the resilient deformation of the resilient contact 25.

The widthwise center of the resilient contact 25 is deviated from that of the rectangular tube 10. This means the presence of a dead space between the resilient contact 25 and the right side plate 13R, which is a side plate more distant from the resilient contact 25. However, the intrusion restricting portion 21 is in this dead space and uses the dead space effectively.

The locking hole 19 is formed over substantially the entire width of the rectangular tube 10 and the exposure of the bottom end surfaces of the left and right side plates 13L, 13R of the rectangular tube 10 in the opening area of the locking hole 19. The bottom end of the right side plate 13R facing the locking hole 19 is embossed to project inward, thereby forming the intrusion restricting portion 21. The stamping or embossing forming method is easily workable as compared to cutting and bending. Therefore, a processing cost can be reduced.

The locking plates 15F, 15R extend from the extending of the ceiling plate 14 towards the bottom plate 12 substantially along the inner surface of the right side plate 13R, and the projections 30F, 30R at the right edge of the resilient contact 25 are brought substantially into contact with the bottom edges of the locking plates 15F, 15R to restrict displacement of the resilient contact 25 towards the tab entrance space 32. Thus, it is not necessary to form locking holes in the right side plate 13R and there is no reduction in the strength of the right side plate 13R or the rectangular tube 10 can be avoided.

The widthwise center of the inner space of the rectangular tube 10 where the resilient contact 25 is accommodated is deviated laterally from the widthwise center of the rectangular tube 10 because of the presence of the locking plates 15F, 15R. The resilient contact 25 would have to be narrowed by as much as this deviation if the resilient contact 25 and the rectangular tube 10 were to have their widthwise centers at the same widthwise position. However, a dead space is left at the side opposite the locking plates 15F, 15R in the inner space of the rectangular tube 10, and the widthwise center of the resilient contact 25 is deviated to the side opposite to the locking plates 15F, 15R. Therefore, a large width can be ensured for the resilient contact 25 and the dead space in the inner space of the rectangular tube 10 is minimized.

The pressing portion 38 can be brought into contact with the upper edge of the front locking plate 15F from above by extending towards the ceiling plate 14. Additionally, the recess 37 is formed at the extending edge of the right side plate 13R, and the front locking plate 15F has its upward or outward displacement prevented by the pressing portion 38. Thus, a displacement of the resilient contact 25 towards the tab entrance space 32 is prevented.

The upper edge of the front locking plate 15F is recessed to form the recess 37, and the pressing portion 38 is accommodated in the recess 37. Thus, there is no step between the upper surface of the ceiling plate 14 and that of the pressing portion 38 on the upper surface of the rectangular tube 10.

The pressing portion 38 formed at the upper edge of the right side plate 13R prevents an upward or outward displacement of the extending edge of the ceiling plate 14. The pressing portion 38 is accommodated in the recess 37. Thus, the height of the rectangular tube 10 is reduced by the absence of the step between the upper surface of the ceiling plate 14 and that of the pressing portion 38 on the upper surface of the rectangular tube 10.

The front locking plate 15F is formed with the recess 37 and extends substantially along the inner surface of the right side plate 13R. Thus, the front locking plate 15F reinforces the right side plate 13R, which in turn enhances the strength of the entire rectangular tube 10.

The receiving plate 35 extends from the front edge of the right side plate 13R substantially at a right angle and towards the resilient contact 25. Additionally at least part of the extending edge of the receiving plate 35 facing the tab entrance space 32 is in an area between the right side plate 13R and the resilient contact 25 along the width direction. Furthermore, the probe P is brought into contact with the receiving plate 35. Thus, a contact area of the probe P along the width direction is wider than the thickness of the right side plate 13R and the probe P can be brought securely into contact with the rectangular tube portion 10 even if displaced in the width direction. In addition, at least the part corresponding to the tab entrance space 32 along the height direction is in the area between the right side plate 13R and the resilient contact 25 along the width direction. Therefore, the receiving plate does not interfere with the tab 54 entering the tab entrance space 32.

The receiving plate 35 is formed over substantially the entire height of the right side plate 13R to increase the touchable area of the probe P along the height direction. Thus, a degree of freedom in designing is increased for setting the arrangement of the work openings 56 as the entrance openings for the probe P in the housing 50.

The widthwise center of the resilient contact piece could be made to coincide with that of the rectangular tube. In this case, the width of clearances between the side plates and the resilient contact would be substantially half the difference between the width of the rectangular tube and that of the resilient contact. Contrary to this, the widthwise center of the resilient contact 25 is deviated from that of the rectangular tube 10 in this embodiment. Thus, the width of the wider clearance between the side plate and the resilient contact 25 is larger than half the difference between the width of the rectangular tube 10 and that of the resilient contact 25. Accordingly, a large extending distance from the right side plate 13R can be ensured for the receiving plate 35.

The front end surface 35F of the receiving plate 35 is before the front end of the resilient contact 25. Thus, there is no likelihood of the probe P interfering with the resilient contact 25 even if part of the probe P does not touch the receiving plate 35.

The slanted guide surface 36R is formed at the extending edge of the receiving plate 35 and corrects the position of the tab 54 towards the tab entrance space 32 if the tab 54 is displaced towards the receiving plate 35. Accordingly, there is no likelihood that the tab 54 will strike the receiving plate 35.

The base portion 33 is formed narrower than the bottom plate 12 by cutting away the left and/or right edge(s) close to the front end of the bottom plate 12, and the bend 26 at the front end of the resilient contact 25 is connected with the front end of the base portion 33. The base portion 33 has the bulge 34 bulging out from the side edge of the base portion 33 toward the right side plate 13R of the rectangular tube 10. The bulge 34 narrows an area of the opening between the base portion 33 and the right side plate 13R and substantially prevents intrusion of external matter into the rectangular tube 10 through this opening. Further, the base portion 33 is wider and is reinforced by forming the bulge 34. Thus, a deformation of the base portion 33 resulting from the interference with external matter can be prevented even if the resilient contact 25 is narrow.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

One displacement restricting portion is near the contact point in the foregoing embodiment. However both displacement restricting portions may be distant from the contact point according to the invention.

One displacement restricting portion is near the free end of the resilient contact in the foregoing embodiment. However, both displacement restricting portions may be distant from the free end according to the invention.

The projections project from the left and right edges of the resilient contact for contacting the displacement restricting portions in the foregoing embodiment. However, the projections may project only from one edge.

The right projections are brought into contact with the locking plates in the foregoing embodiment. However they may be brought into contact with the opening edges of the locking holes formed in the side plate.

The contact is located before the locking hole in the foregoing embodiment. However, the invention is also applicable to terminal fittings in which a contact point is at a position substantially corresponding to a locking hole and/or at a position substantially behind the locking hole.

The resilient contact and the displacement restricting portions are not in contact unless the resilient contact is in contact with the tab in the foregoing embodiment. However, they may be in contact even if the resilient contact and the tab are not in contact according to the invention.

The projections on the resilient contact are brought into contact with the displacement restricting portions in the foregoing embodiment. However, the lateral edges of the resilient contact may contact the displacement restricting portions without providing any projection according to the invention.

The resilient contact is supported on or at the bottom plate at or close to the front end thereof in the foregoing embodiment. However, the resilient contact may be supported at the rear end bottom plate.

The widthwise center of the resilient contact is deviated from that of the rectangular tube in the foregoing embodiment. However, the invention is also applicable to terminal fittings in which the widthwise centers of a resilient contact and a rectangular tube substantially coincide.

The widthwise center of the locking hole coincides with that of the rectangular tube in the foregoing embodiment. However, the widthwise center of the locking hole may deviate from that of a rectangular tube.

The locking hole is formed over substantially the entire width of the rectangular tube in the foregoing embodiment. However, the invention is also applicable to a case where the locking hole is narrower than the tube.

The tube described above has a substantially rectangular cross-section. However, the invention is equally applicable to tubes with other shapes, particularly substantially polygonal (triangular, pentagonal, hexagonal, etc.) shapes or substantially round, circular, oval, elliptical or the like shapes.

The projections are formed on the lateral edges of the resilient contact and are brought into contact with the locking plate in the foregoing embodiment. However, the lateral edges of the resilient contact may be brought into contact with the locking plates without forming any projection on the lateral edges of the resilient contact according to the invention.

The locking plate is pressed from above by the pressing portion in the foregoing embodiment. However, there may be no pressing portion.

The upper surface of the pressing portion is substantially flush with that of the ceiling plate in the foregoing embodiment. However, it may be higher or lower than the upper surface of the ceiling plate.

The locking plates are at front and rear positions and the resilient contact is brought into contact with the locking plates at two front and rear positions in the foregoing embodiment. However, the resilient contact may be contact the locking plate at one position or at three or more positions.

What is claimed is:

1. A terminal fitting, comprising: a substantially rectangular tube with opposite front and rear ends and being hollow in forward and backward directions, the rectangular tube having a base plate with opposite first and second sides, first and second side plates projecting from the respective first and second sides of the base plate, and a ceiling plate extending from the first side plate towards the second side plate, the ceiling plate being formed with at least one locking plate projecting at an angle from an edge of the ceiling plate opposite the first side plate and extending substantially along an inner surface of the second side plate, and a resilient contact in the tube and extending substantially in the forward and backward directions, the resilient contact being configured for resiliently contacting a tab of a mating connector inserted into a tab entrance space of the tube, and at least one lateral edge of the resilient contact being engageable with an extending edge of the locking plate to restrict displacement of the resilient contact piece towards the tab entrance space.

2. The terminal fitting of claim 1, further comprising a locking hole formed in the base plate of the tube at a side of the resilient contact substantially opposite the tab entrance space, whereby the locking hole is engageable with a lock on an inner wall of a cavity of a connector housing for retaining the terminal fitting in the cavity.

3. The terminal fitting of claim 2, wherein the at least one locking plate comprises front and rear locking plates provided at respective positions in the tube before and behind the locking hole.

4. The terminal fitting of claim 3, wherein the resilient contact has a contact point for contacting the tab, the contact point being behind the front locking plate and before the rear locking plate.

5. The terminal fitting of claim 3, wherein the resilient contact cantilevers from the base plate of the tube, the resilient contact having a rear end aligned with part of the rear locking plate in a front-to-rear direction.

6. The terminal fitting of claim 1, wherein the resilient contact has at least one projection projecting out substantially along a width direction from a lateral edge thereof, the projection being disposed for contact with a portion of the locking plate.

7. The terminal fitting of claim 1, wherein a widthwise center of the resilient contact is offset from a widthwise center of the tube towards the first side plate and opposite the locking plate.

8. The terminal fitting of claim 1, wherein at least one pressing portion is formed at an edge of the second side plate opposite the base plate and extending substantially toward the ceiling plate for contacting an edge of the locking plate from outside.

9. The terminal fitting of claim 8, wherein the locking plate is formed with a recess, and at least part of the pressing portion being accommodated in the recess.

* * * * *

UNITED STATES PATENT AND TRADEMARK OFFICE

CERTIFICATE OF CORRECTION

PATENT NO. : 7,223,135 B2
APPLICATION NO. : 11/344847
DATED : May 29, 2007
INVENTOR(S) : Yutaka Noro et al.

It is certified that error appears in the above-identified patent and that said Letters Patent is hereby corrected as shown below:

Title Page, Item (75) Inventors: Should Read,
--(75) Inventors: Yutaka Noro, Yokkaichi (JP);
Ryotaro Ishikawa, Yokkaichi (JP);
Hajime Kawase, Yokkaichi (JP);
Keiichi Nakamura, Yokkaichi (JP);
Yutaka Kobayashi, Yokkaichi (JP)--

Title Page, Item (12), Delete "Nora" and insert -- Noro --.

Signed and Sealed this

Twenty-fourth Day of July, 2007

JON W. DUDAS
*Director of the United States Patent and Trademark Office*